US008523406B2

(12) United States Patent
Kwong et al.

(10) Patent No.: US 8,523,406 B2
(45) Date of Patent: Sep. 3, 2013

(54) LED LIGHTING ASSEMBLY WITH DETACHABLE POWER MODULE AND LIGHTING FIXTURES WITH SAME

(75) Inventors: Allan Hing Chuen Kwong, Stanley (CN); Jun Zhang Zhu, Guang Dong (CN)

(73) Assignee: China Lighting Engineering Co., Ltd., Kowloon (HK)

( * ) Notice: Subject to any disclaimer, the term of this patent is extended or adjusted under 35 U.S.C. 154(b) by 226 days.

(21) Appl. No.: 13/092,544

(22) Filed: Apr. 22, 2011

(65) Prior Publication Data

US 2012/0170287 A1 Jul. 5, 2012

(30) Foreign Application Priority Data

Jan. 4, 2011 (CN) ..... 2011 2 0013923 U

(51) Int. Cl.
*F21V 3/00* (2006.01)
*F21V 5/00* (2006.01)

(52) U.S. Cl.
USPC ..... 362/311.02; 362/249.02; 362/800

(58) Field of Classification Search
USPC ..... 362/249.02, 311.02, 800
See application file for complete search history.

(56) References Cited

U.S. PATENT DOCUMENTS

| | | | |
|---|---|---|---|
| 7,549,786 | B2 | 6/2009 | Higley et al. |
| 7,744,266 | B2 | 6/2010 | Higley et al. |
| 2010/0225216 | A1 | 9/2010 | Lee |

FOREIGN PATENT DOCUMENTS

| | | | |
|---|---|---|---|
| CN | 201203057 | Y | 3/2009 |
| CN | 101639166 | A | 2/2010 |
| CN | 201396640 | Y | 2/2010 |
| CN | 201420996 | Y | 3/2010 |
| CN | 201507811 | U | 6/2010 |
| JP | 2003068129 | A | 3/2003 |
| JP | 2007258434 | A | 10/2007 |
| JP | 2009266625 | A | 11/2009 |

OTHER PUBLICATIONS

"Luminaire" Abstract in English of Japan Patent application publication JP2003068129(A). (Mar. 7, 2003).
"Light-Emitting Module and Lighting Apparatus", Abstract in English of Japan Patent application publication JP2007258434(A), (Oct. 4, 2007).
"Structure Capable of Replacing LED Lamp" Abstract in English of China patent application publication CN201203057 (Mar. 4, 2009).
"Lighting System, Liquid Crystal Display Device, and Electronic Apparatus", Abstract in English of Japan Patent application publication JP2009266625(A), (Nov. 12, 2009).
"Combined type illuminating lamp with replaceable LED light-emitting diode", Abstract in English of China Patent application publication CN101639166(A), (Feb. 3, 2010).
"LED Down Lamp with Replaceable Light Source", Abstract in English of China Patent application publication CN201396640(Y), (Feb. 3, 2010).
"LED Street Lamp", Abstract in English of China Patent application publication CN201420996(Y), (Mar. 10, 2010).

*Primary Examiner* — Jason Moon Han
(74) *Attorney, Agent, or Firm* — Baker Donelson Bearman Caldwell & Berkowitz, PC

(57) ABSTRACT

An LED light assembly has a heat sink and electrical conductors for electrical communication with a supply of electricity. A ceramic base with an LED chip attaches to the heat sink. Electricity communicating pads in the ceramic base each operatively connect with the LED chip and with the electrical connectors. A plate defines an aperture and overlies the ceramic base for passage of light from the LED chip. The LED light assembly attaches to a housing of a lighting fixture that may include a light shade.

29 Claims, 4 Drawing Sheets

LED LIGHTING ASSEMBLY WITH DETACHABLE POWER MODULE AND LIGHTING FIXTURES WITH SAME

TECHNICAL FIELD

The present invention relates to luminaries for lighting applications. More particularly, the present invention relates to lighting fixtures with LED lamp assemblies having readily replaced LED lamps and drivers.

BACKGROUND

While incandescent and fluorescent lighting provide illumination for buildings, signage, and the like, environmental and operational factors are leading to development of alternative illumination devices. A significant amount of the electrical energy necessary to operate incandescent lamps is lost as waste heat. Fluorescent lamps have operation temperatures that are cooler and thus have less heat loss arising from converting electrical energy to light. Often, however, fluorescent lighting is not as satisfactory due to the color of the light that is produced. Incandescent lamps generally have a shorter life than that of wattage-equivalent fluorescent lamps.

Accordingly, there is a need in the art for a readily-changed lighting assembly for lighting fixtures, which provides economical operating features. It is to such that the present invention is directed.

SUMMARY OF THE INVENTION

The present invention meets the need in the art by providing an LED light assembly for installation in a lighting fixture, comprising a heat sink defining at least one first passageway therethrough and a pair of electrical conductors each extending through the first passageway for electrical communication with a supply of electrical current. An LED chip attaches to a ceramic base and the ceramic base attaches to the heat sink. The ceramic base includes a pair of spaced-apart electricity communicating pads each operatively connected with the LED chip and with a respective one of the pair of electrical connectors. A plate defines an aperture and overlies the ceramic base for passage of light from the LED chip.

In another aspect, the present invention provides a lighting fixture having an LED light assembly, comprising a housing that connects to an LED assembly that comprises a heat sink defining at least one first passageway therethrough and a pair of electrical conductors each extending through the first passageway for electrical communication with a supply of electrical current. An LED chip attaches to a ceramic base and the ceramic base attaches to the heat sink. The ceramic base includes a pair of spaced-apart electricity communicating pads each operatively connected with the LED chip and with a respective one of the pair of electrical conductors. A plate defines an aperture and overlies the ceramic base for passage of light from the LED chip. A light distribution member attaches to the plate overlying the aperture and a lamp shade attaches to the housing.

Objects, features, and advantages of the present invention will become readily apparent upon reading of the following detailed description in conjunction with the drawings and the appended claims.

DETAILED DESCRIPTION

Figure 1:
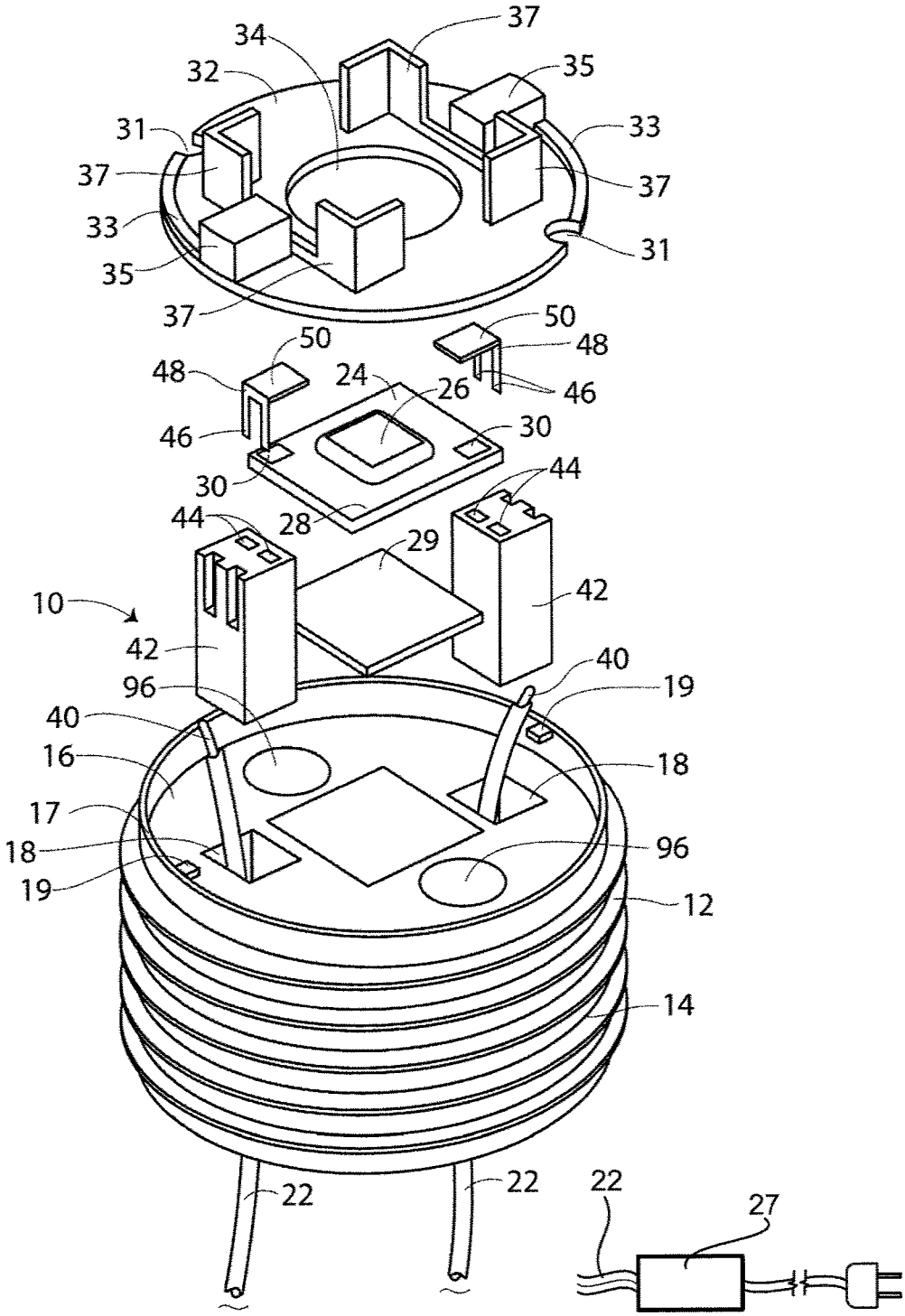
FIG. 1 illustrates an exploded perspective view of an illustrative embodiment of an LED lighting assembly in accordance with the present invention.

With reference to the drawings in which like reference numerals indicate like parts, FIG. 1 illustrates in exploded perspective view an illustrative embodiment of an LED lighting assembly 10 in accordance with the present invention for installation in a lighting fixture. The LED light assembly 10 includes a heat sink 12 having a threaded exterior 14 and a receiving side 16. In the illustrated embodiment, the receiving side 16 is recessed and a perimeter wall 17 extends axially. A lug 19 projects from an inner surface of the wall 17. A pair of first passageways 18 extend through the heat sink 12. An alternate embodiment provides a single first passageway 18. A pair of electrical conductors 22 extend through the first passageways 18 for electrical communication with a supply of electrical current (not illustrated).

A ceramic base 24 and an attached LED chip 26 define an LED power package 28. The LED chip 26 includes a conventional LED device that illuminates upon supply of electrical current through a conventional LED driver 27 to the LED device. The LED driver may be situated outside of the lighting fixture for driving a plurality of connected LED devices. The LED driver receives line current (for example, in the United States, 110-240 V AC, 60 Hz) and provides power output to operate or drive the LED devices (for example but not of limitation, 4-32 V DC, at 350 mA, with a power output of 1.2 to 10.8 watts). The LED driver is conventional and selected based on the watts of the LED devices to be driven or illuminated. The LED driver discussed above is exemplary only and not a limitation on embodiments of the invention.

The ceramic base 24 includes a pair of electrical pads 30 that operatively connect to a supply of electrical current from the LED driver. The power package 28 attaches to the receiving side 16 of the heat sink 12. In the illustrated embodiment, a thermally communicative epoxy 29 adheres the ceramic base 24 to the receiving side 16. A plate 32 defining an aperture 34 attaches to the heat sink 12 on the receiving side 16 with the aperture in overlying relation to the LED chip 26 for passage of light from the LED chip. The plate 32 is received in the recess within the wall 17. The plate 32 defines a notch or slot 31 in an edge portion. A ramp 33 extends in the plate 32 arcuately from the slot 31 to a stop member 35 extending from the plate. FIG. 1 also shows an alternate embodiment in which a second one of the slot 31 and the ramp 33 are defined in opposing relation to the first slot 31 and ramp 33, for assembly and use purposes, together with a second opposing lug 19 that extends from the wall 17. Alternate embodiments use other means to detachably attach the plate 32 to the heat sink 12, including fasteners extending through the plate into bores in the heat sink, with pivotable spring clips, with adhesive, or other holding connectors. The plate 32 further defines spaced-apart upstanding walls 37, for a purpose discussed below. The power package 28 in the illustrative embodiment has length and width of 15 mm×12 mm and conventionally accepts a range of wattages for the LED device.

In the illustrated embodiment, the electrical conductors 22 comprise a pair of electrical wires 40 that extend through the first passageways 18. Each of the wires 40 engages a respective housing 42 for electrical contact. The housing 42 is received in the passageway 18. The housing 42 defines a channel 44. The channel 44 receives a leg 46 of an L-shaped electrical connector 48. A second leg 50 of the electrical connector extends laterally. The second leg 50 contacts a respective one of the pads 30 for communicating electrical current to the power package 28. The pair of electrical connectors 48 mechanically clip the ceramic base 24 to the heat sink 12 while also providing for communication of electrical current from the supply to the power package 28 for illumination of the LED device. The L-shaped connector 48 is held firmly by the leg in contact with the channel 44, and pressed firmly into engagement, bears forcibly through the pads 30 against the ceramic base 24 to facilitate electrical current passing through the contacting surfaces of the electrical pads 30 and the connector 48.

Figure 2:
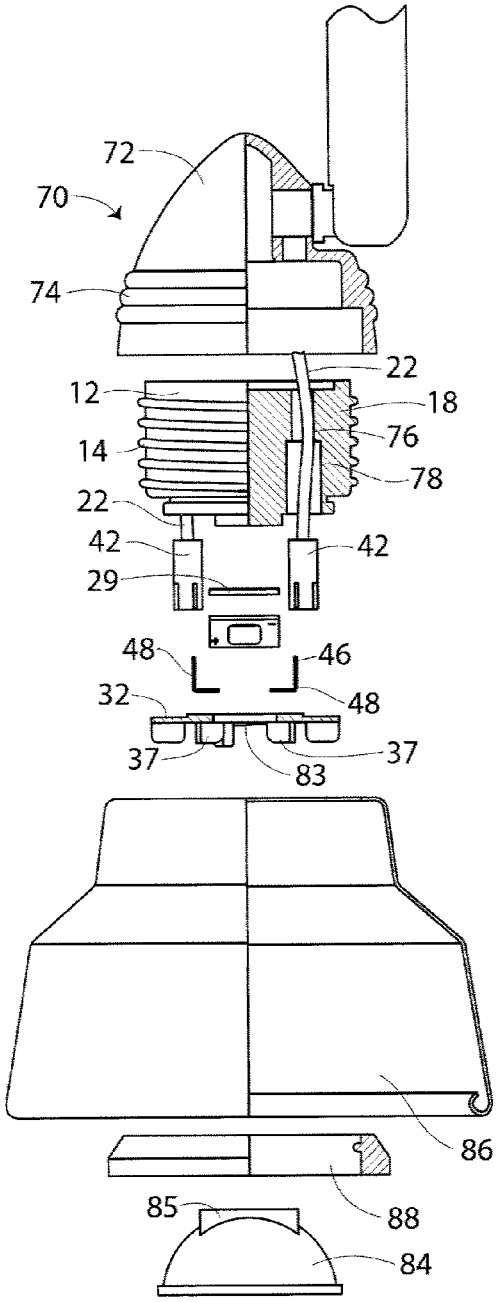
FIG. 2 illustrates a cut-away side view of a lighting fixture using the LED lighting assembly illustrated in FIG. 1.

FIG. 2 illustrates a cut-away side view of a lighting fixture 70 using the LED lighting assembly 10 illustrated in FIG. 1. The lighting fixture 70 includes a housing 72 configured conventionally for a lighting fixture. In the illustrated embodiment, the housing 72 defines a threaded portion 74 sized for threadably engaging the threaded heat sink 12. The first passageway 18 in the illustrated embodiment has a first portion 76 and a second portion 78. The first portion 78 defines a circular cross-section bore for receiving the wire 40. The second portion 78 is rectangular in cross-section for seating the electrical connector 48 in the heat sink. As discussed above, the leg 46 of the electrical connector 48 inserts into the channel 44 of the housing 42 and contacts the wire 40 for electrical communication. The wire 40 and the leg 46 engage for electrical communication.

A light distributing device 84 attaches to the plate 32 with the walls 37 bearing against a base of the light distributing device 84. The walls 37 are disposed in spaced-apart relation for defining a seat 83 that receives a base 85 of the light distributing device 84. The light distributing device 84 is a reflector or a lens. The light distributing device 84 may also attach to the plate 32 with fasteners, adhesive, or other connector devices.

The heat sink 12 slidably receives a lamp shade 86 that abuts the housing 72. In the illustrated embodiment, a ring 88 threads on the threaded exterior 14 of the heat sink 12 to secure the lamp shade 86 to the heat sink 12. The lamp shade 86 may attach with separate fasteners such as rivets, screws, or pins; may have a pin and arcuate slot arrangement for engaging the lamp shade to the housing or to the heat sink; may use a ramp and stop structure for rotatably attaching the lamp shade to the housing or heat sink; or other conventional attaching members. The pin and slot arrangement for example uses pins projecting from the lamp shade into slots defined in the side wall of the heat sink. The lamp shade rotates as the pin is guided by the arcuate slot to seat the lamp shade relative to the housing 72. In an alternate embodiment, the pins project from the heat sink 12 and the arcuate slots are defined in the lamp shade. The ramp and stop connector uses a structure such as that discussed above for the plate 32 detachably attached to the heat sink.

Figure 3:
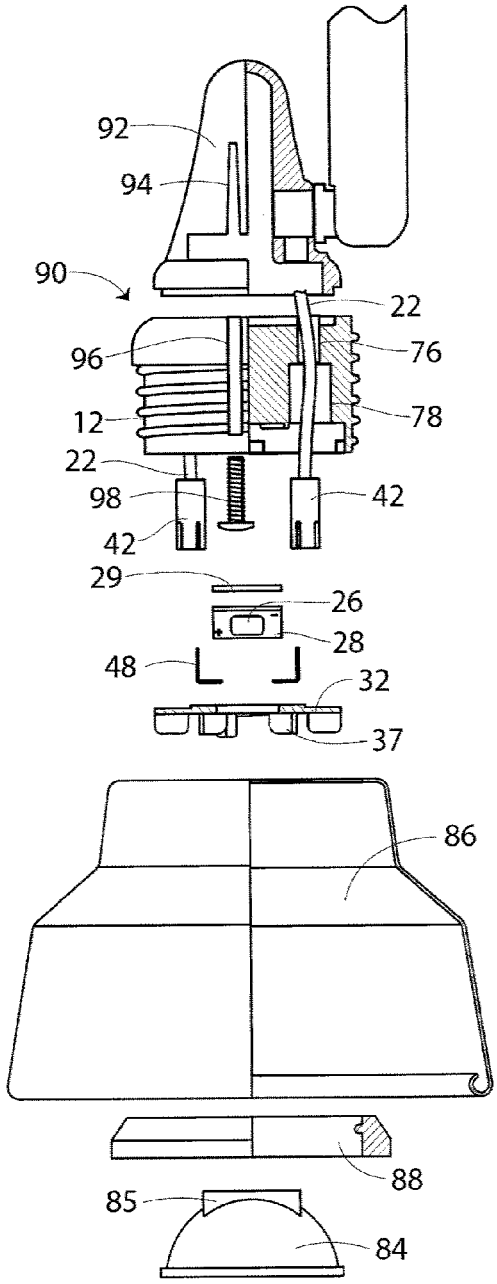
FIG. 3 illustrates a cut-away side view of an alternate embodiment of a lighting fixture using the LED lighting assembly illustrated in FIG. 1.

FIG. 3 illustrates a cut-away side view of an alternate lighting fixture 90 using the LED lighting assembly 10 illustrated in FIG. 1. The lighting fixture 90 includes a housing 92 configured conventionally for a lighting fixture. The housing 92 includes a pair of receiving members 94 each having a central bore (one receiving member 94 is illustrated). The wire 40 22 extends through the first portion 76 of the passageway 18 to engage the electrical connector 48 received in the housing 42 in the second portion 78. The leg 46 of the electrical connector 48 inserts into the channel 44 of the housing 42 and contacts the wire 22 for electrical communication.

The heat sink 12 in the illustrated embodiment further defines a pair of second passageways 96, as an alternate embodiment for engaging the heat sink to the light fixture. The second passageways 96 each align with a respective one of the receiving members 94 of the housing 92. Fasteners 98 extend through the second passageways 96 and into the receiving members 94 to secure the heat sink 12 to the housing 92. In an alternate embodiment, the plate 32 may include holes through which the fasteners 98 extend so the plate does not use the slot 31, ramp 33, and stop 35 with the lug 19. It is to be appreciated that the heat sink attaches to the housing in alternative ways, including swedging the heat sink into the housing, adhesive, fasteners, or other conventional connecting mechanisms by which a heat sink attaches or connects to a housing, plate, or support.

The light distributing device 84 attaches to the plate 32 with the walls 37 bearing against the base 85 of the light distributing device 84. As noted above, the light distributing device 84 is a reflector or a lens for directing or communicating light outwardly of the lamp shade 86. The heat sink 12 slidably receives the lamp shade 86 that abuts the housing 92. The ring 88 threads on the threaded exterior of the heat sink 12 to secure the lamp shade 86 to the heat sink 12.

As discussed below, the plate 32 also presses the LED power package 28 firmly into contact with the heat sink 12 to facilitate heat transfer through the thermally communicative epoxy 29 to the heat sink. This is accomplished, as discussed below, by the plate 32 being received in the recess defined by the receiving side 16 and wall 17. The lug 19 passes through the slot 31 of the plate 32. Moving the plate 32, in the illustrated embodiment by rotating through a slight angle, causes a lower surface of the lug 19 to travel on the ramp 33 until contacted by the stop 35. This locks the plate 32 to the heat sink and provides a pressing force with the plate 32 in close contact with the heat sink 12.

Figure 4:
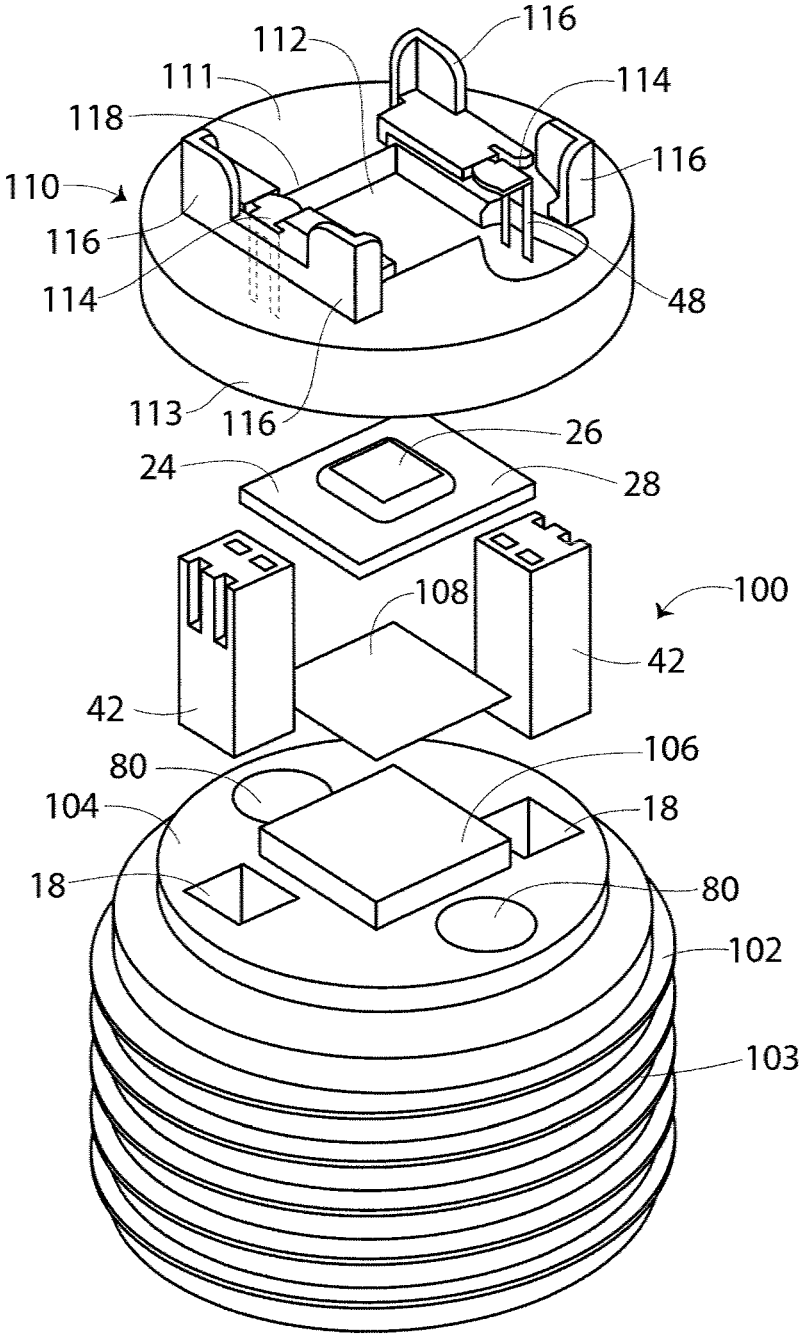
FIG. 4 illustrates an exploded perspective view of a second illustrative embodiment of an LED lighting assembly in accordance with the present invention.

FIG. 4 illustrates an exploded partially cut-away perspective view of a second illustrative embodiment 100 of an LED lighting assembly in accordance with the present invention. The LED lighting assembly 100 includes an alternate heat sink 102 with the passageways 18, 80 and threaded exterior 103. The heat sink 102 defines a projecting opposing side 104 that has a land 106 to which the ceramic base 24 attaches with thermally communicative epoxy 108. A cap 110 has a plate portion 111 and a depending skirt 113. The cap 110 defines an aperture 112 and overlies the ceramic base 24 of the power package 28. The LED chip 26 is received within the aperture 112. A pair of electrical connectors 114 embed in the cap 110 and have legs that engage the housing 42 that receive the wires 40 (not illustrated in FIG. 4). Walls 116 extend from the cap 110 for defining a seat 118 for the base 85 of the light distributing device 84, such as a reflector or lens. The cap 110 detachably attaches to the heat sink with mechanical locking members such as the lug 19 and ramp 33 mating members, with projecting pin and receiving slot structure, with a tapering cam that bears against a projecting pin, or other suitable mechanical engaging structure or lock device, or alternatively, with a detachable adhesive.

Figure 5:
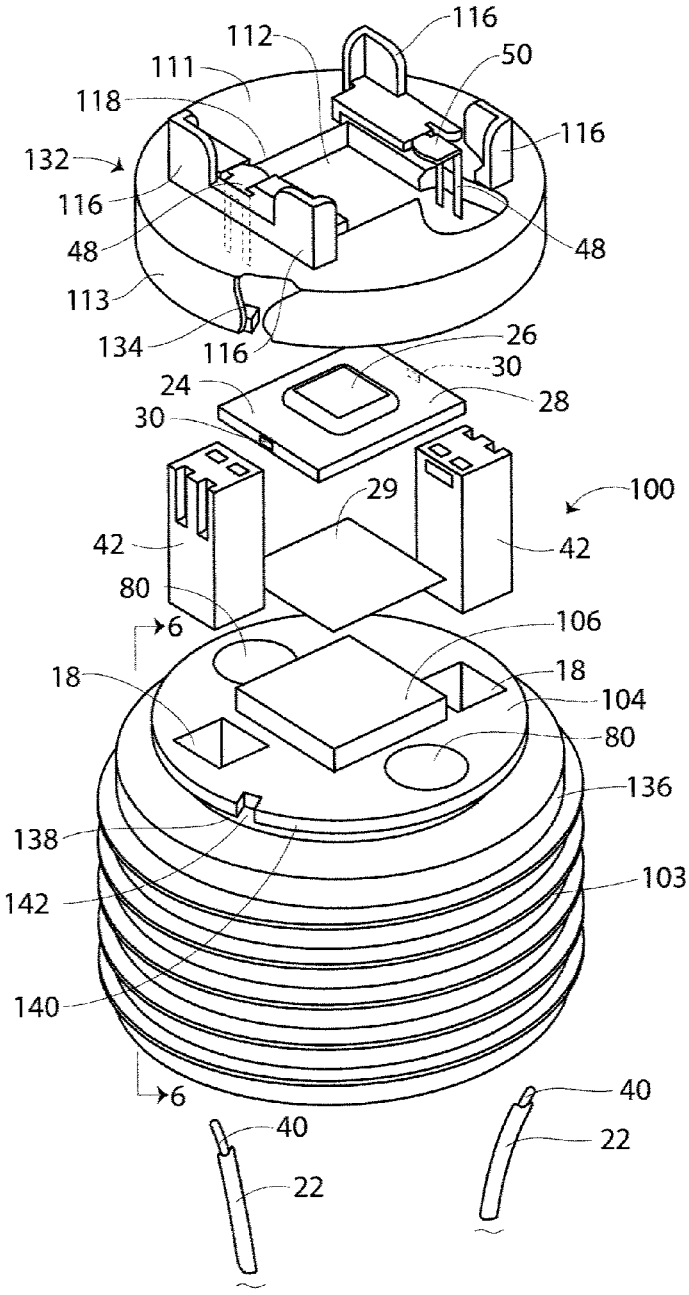
FIG. 5 illustrates an exploded perspective view of an alternate embodiment of an LED lighting assembly in accordance with the present invention.
Figure 6:
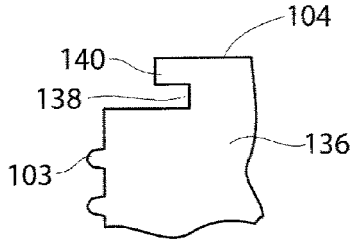
FIG. 6 illustrates a detailed side view of the LED lighting assembly shown in FIG. 5 and taken along line 6-6.

FIG. 5 illustrates in exploded perspective view an alternate embodiment of the LED assembly 130 in which a cap 132 structurally similar to the cap 110 discussed above but includes a lug 134 (shown in partial cut-away) projecting from an inner surface of a skirt 113. The side 104 of a heat sink 136 defines a recess 138 and a perimeter extending flange 140 as best illustrated in detailed side view in FIG. 6 taken along line 6-6 of FIG. 5. In one embodiment, the cap 130 snap-fits onto the side 104 to insert the lug 134 into the recess 138. In the illustrated embodiment, the flange 140 defines a slot 142 for passage of the lug 134 when seating the cap 130 on the heat sink 136 with the lug 134 received in the recess 138. The legs 46 of the electrical connectors 48 used in this embodiment insert into the housings 42 and the lateral legs 50 are disposed in contact with the underside surface of the side 104. It is to be appreciated that in an alternate embodiment, the slot 142 and the flange 140 may be defined only in a portion of the perimeter of the side 104 of the heat sink.

With reference to FIG. 1, the LED power package 28 attaches with the epoxy 29 to the receiving side 16 of the heat sink 12. The electrical connectors 48 engage the housings 42 by inserting the legs 46 into the channels 44. The legs 50 contact the pads 30 for electrical communication. The plate 32 attaches by aligning the slot 31 with the lug 19. The plate 32 seats into the recess defined by the walls 17. The plate 32 rotates through a slight angle, with a lower surface of the lug 19 riding or traveling on the ramp 33 until contacted by the stop 35. The plate 32 mechanically clips or locks the power package 28 to the heat sink and pushes the pad 30 and the leg 50 together for electrical communication. An alternate embodiment (not illustrated) uses a plate that slides laterally relative to the heat sink rather than rotates in order for the lug 19 to travel on a longitudinally extending ramp after sliding through a slot leading to the ramp.

With reference to FIG. 2, the LED light assembly 10 (or 100) attaches to the housing 72 of the light fixture 70. This is accomplished by threading the heat sink 12 into engagement with the threads 74 of the housing 72. With reference to FIG. 3, the LED light assembly 10 (or 100) attaches to the housing 92 with the fasteners 98 extending through the second passageways 96 and into the receiving members 94 of the housing 92. In an alternate embodiment, the fasteners 98 pass through holes in the plate 32 to secure the plate also to the heat sink 12.

With continuing reference to FIGS. 2 and 3, the reflector or lens for the light distribution device 84 seats against the walls 37 of the plate 32. (With the embodiment illustrated in FIG. 4, the light distribution device 84 seats against the walls 116 of the cap 110.) The heat sink 12 receives the lamp shade 86, and the ring 88 threads on the heat sink to secure the lamp shade to the heat sink. The wires 40 connect to a supply of electrical current (not illustrated). Under selective operation with a switch, the LED light assembly 10 provides electrical current to the power package 28 for illuminating the LED device that is controlled by the LED driver on the chip. The thermally conductive epoxy facilitates transfer of heat from the LED device to the heat sink. The heat sink is an aluminum or graphite member.

The LED light assembly is readily assembled with a range of wattage of LED devices. The power package 28 is mechanically clipped to the heat sink so that the LED device and driver can be exchangeable among power packages of standardized sizes with different wattage of LED chip as may be required from time to time. Thus, the present invention facilitates use of LED lighting that is typically long-duration life but the LED device is readily changed if illumination requirements change or the LED device or chip fails.

The LED device is changed by reversing the assembly process discussed above. This is accomplished by removing the ring 88 and the lamp shade 86. The light distributing device 84 is detached. The plate 32 is then removed to provide access to the electrical connectors 48 and the LED power package 28. In the embodiment illustrated in FIG. 1, the plate 32 is rotated angularly so the lug 19 travels on the ramp 33 from the stop 35 to the slot 31. The plate 32 is removed, providing access to the electrical connectors 48 and the LED power package 28. The electrical connectors 48 are removed from the housings 42. The LED power package 28 is detached from epoxy engagement with the heat sink. The epoxy 29 is cleaned from the surface of the heat sink. A new LED power package 28 is detachably engaged with fresh thermal communicative epoxy 29. The electrical connectors 48 and the plate 32 re-installed as discussed above. The lighting distributing member 84 is attached to the plate 32 held by the walls 37, and the lamp shade 86 attached with the ring 88.

The alternate embodiments, such as the embodiment illustrated in FIG. 4 using the cap 110, are similarly assembled for use with a light fixture, and disassembled for replacing the detachably attached LED power package. It is believed that upon reading of the foregoing specification and discussion of the alternate embodiments, the assembly and use of such alternate embodiments will be well apparent as consistent with the present invention.

With reference to FIG. 5, the cap 132 attaches to the heat sink 136 by passing the lug 134 through the slot 142 of the flange 140. The cap 132 then rotates through a small angle to seat the lug within the recess 138 and held by the flange 140. In an alternate embodiment that does not include the slot 142, the cap 132 snap-fits over the side 104 to insert the lug 134 into the recess 138. This presses the LED power package 28 firmly into contact with the heat sink 136 to facilitate heat transfer through the thermally communicative epoxy 29 to the heat sink while the electrical connectors 48 communicate with the pads 30 for supply of electrical current to the LED power package.

The foregoing specification accordingly describes the present invention that provides an LED lighting assembly providing readily-replaced operationally economical illumination in lighting fixtures. It is to be understood, however, that numerous changes and variations may be made in the construction of the LED lighting assembly within the spirit and scope of the present invention and that modifications and changes may be made therein without departing from the scope thereof as set forth in the appended claims.

What is claimed is:

1. An LED light assembly for installation in a lighting fixture, comprising:

a heat sink defining at least one first passageway therethrough;

a pair of electrical conductors each extending through the first passageway for electrical communication with a supply of electrical current from the lighting fixture;

a ceramic base to which an LED chip is attached, the ceramic base attached to the heat sink, the ceramic base having a pair of spaced-apart electricity communicating pads each operatively connected with the LED chip and with a respective one of the pair of electrical connectors; and a plate defining an aperture and overlying the ceramic base for passage of light from the LED chip.

2. The LED light assembly as recited in claim 1, wherein the ceramic base is detachably attached to the heat sink to facilitate replacing the LED chip when non-functional.

3. The LED light assembly as recited in claim 1, further comprising means for connecting the heat sink to a lighting fixture.

4. The LED light assembly as recited in claim 3, where means for connecting comprises:

the heat sink defining a pair of second passageways therethrough; and fasteners extending through the second passageways for engaging a housing of a lighting fixture.

5. The LED light assembly as recited in claim 1, further comprising means for attaching a light shade to the heat sink.

6. The LED light assembly as recited in claim 5, wherein means for attaching comprises:

the heat sink defining a threaded exterior; and further comprising a ring for threading onto the heat sink for securing a lamp shade to the housing, which lamp shade being slidably received on the heat sink.

7. The LED light assembly as recited in claim 1, further comprising a light distribution member attached to the plate for distributing light from the LED chip.

8. The LED light assembly as recited in claim 7, wherein the light distribution member is a reflector.

9. The LED light assembly as recited in claim 7, wherein the light distribution member is a lens.

10. The LED light assembly as recited in claim 1, wherein the heat sink defines a pair of spaced-apart first passageways and the pair of electrical conductors each extend through a respective one of the first passageways for electrical communication with the supply of electrical current; and further comprising:

a pair of electrical connectors each received in a first portion of a respective one of the first passageways and connected to the respective electrical conductor and to the pads on the ceramic base for communicating electrical current between the supply and the LED chip.

11. The LED light assembly as recited in claim 1, wherein the heat sink defines a recess in which the ceramic base seats.

12. The LED light assembly as recited in claim 1, wherein the ceramic base attaches to the heat sink with a thermally communicative epoxy.

13. The LED light assembly as recited in claim 1, wherein the plate defines spaced-apart walls projecting in a first direction, the walls defining a seat for receiving a base portion of a light distribution member that distributes light from the LED light assembly during supply of electrical current thereto.

14. The LED light assembly as recited in claim 1, wherein the heat sink is an aluminum member.

15. The LED light assembly as recited in claim 1, wherein the heat sink is a graphite member.

16. The LED light assembly as recited in claim 1, wherein the connectors bear forceably on the ceramic base to maintain the ceramic base in contact with the heat sink.

17. The LED light assembly as recited in claim 1, further comprising a connecting member received in each first passageway and the electrical conductor comprising a wire for connecting to the supply of electrical current, the connecting member defining at least one channel that extends from a side to a distal end of the wire in the connecting member, the channel receiving a leg of one of a pair of electrical connectors that each contacts one of the pads on the ceramic base to mechanically clip the ceramic base to the heat sink and electrically connect the pad with the supply of electrical current.

18. The LED light assembly as recited in claim 1, further comprising means for attaching the plate to the heat sink.

19. The LED light assembly as recited in claim 18, wherein means for attaching the plate comprises:

a lug projecting from the heat sink; and the plate further comprising:

a slot in an edge of the plate configured for receiving the lug; and a ramp extending from the slot, whereby the plate, placed on the receiving side of the heat sink with the lug passing past the slot, moves with the lug traveling on the ramp to secure the plate to the heat sink.

20. The LED light assembly as recited in claim 19, further comprising a stop to stop the movement of the plate while securing to the heat sink.

21. The LED light assembly as recited in claim 18, wherein means for attaching the plate comprises:

the plate defining a plurality of holes; and fasteners extending through the holes and into bores in the heat sink.

22. The LED light assembly as recited in claim 1, wherein the plate defines a cap having a perimeter skirt.

23. The LED light assembly as recited in claim 22, wherein a lug projects from an inner surface of the skirt; and the heat sink further defines a perimeter recess and an extending flange for engaging the cap to the heat sink.

24. The LED light assembly as recited in claim 23, wherein the flange further defines a slot through which the lug passes for rotatingly attaching the cap to the heat sink.

25. An LED light assembly, comprising:

a housing that connects to an LED assembly that comprises:

a heat sink defining at least one first passageway therethrough;

a pair of electrical conductors each extending through the first passageway for electrical communication with a supply of electrical current;

a ceramic base to which an LED chip is attached, the ceramic base attached to the heat sink, the ceramic base having a pair of spaced-apart electricity communicating pads each operatively connected with the LED chip and with a respective one of the pair of electrical conductors; and a plate defining an aperture and overlying the ceramic base for passage of light from the LED chip; and a light distribution member attached to the plate overlying the aperture; and a lamp shade attached to the housing.

26. The LED lighting assembly as recited in claim 25, further comprising an electrical driver device that receives electrical line voltage and provides electrical current to operate the LED device.

27. The LED light assembly as recited in claim 25, wherein the plate defines a cap having a perimeter skirt.

28. The lighting fixture having an LED light assembly as recited in claim 27 wherein a lug projects from an inner surface of the skirt; and the heat sink further defines a perimeter recess and an extending flange for engaging the cap to the heat sink.

29. The lighting fixture having an LED light assembly as recited in claim 28 wherein the flange further defines a slot through which the lug passes.

* * * * *